US007677839B2

(12) United States Patent
Stoetzer

(10) Patent No.: US 7,677,839 B2
(45) Date of Patent: Mar. 16, 2010

(54) DRILLING IMPLEMENT AND METHOD FOR INSTALLING A DRILLING PILLAR IN THE GROUND

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 196 days.

(21) Appl. No.: 11/790,372

(22) Filed: Apr. 25, 2007

(65) Prior Publication Data

US 2007/0253782 A1 Nov. 1, 2007

(30) Foreign Application Priority Data

Apr. 26, 2006 (EP) ..... 06008684

(51) Int. Cl.
*E02D 7/00* (2006.01)
*E02D 11/00* (2006.01)
*B23Q 5/00* (2006.01)

(52) U.S. Cl. ..... 405/232; 405/241; 173/145; 173/148; 173/164

(58) Field of Classification Search ..... 405/232, 405/233, 236, 240, 241; 173/145, 148, 164, 173/184

See application file for complete search history.

(56) References Cited

U.S. PATENT DOCUMENTS

| | | | |
|---|---|---|---|
| 3,303,656 | A | 2/1967 | Landau |
| 3,604,214 | A | 9/1971 | Turzillo |
| 3,831,159 | A | 8/1974 | Parsons |
| 5,647,690 | A | 7/1997 | Landau |
| 5,875,860 | A | 3/1999 | Coelus |
| 6,517,292 | B1 | 2/2003 | Landau |
| 2003/0123937 | A1 | 7/2003 | Landau |
| 2007/0253782 | A1 | 11/2007 | Stoetzer |
| 2007/0267224 | A1 | 11/2007 | Stoetzer |

FOREIGN PATENT DOCUMENTS

| | | |
|---|---|---|
| DE | 37 38 420 A1 | 5/1989 |
| EP | 0 831 180 A1 | 3/1998 |
| EP | 1 580 325 A1 | 9/2005 |

*Primary Examiner*—Tara Mayo-Pinnock
*Assistant Examiner*—Benjamin Fiorello
(74) *Attorney, Agent, or Firm*—Jacobson Holman PLLC

(57) ABSTRACT

The invention relates to a drilling implement for installing or erecting a drilling pillar in the ground, having a mast, a carriage displaceably mounted on the mast, a rotary drive located on the carriage for the rotary driving of a drill pipe and a pipe bunker connectable to the drill pipe with a storage area for fill material for filling a drill hole on drawing the drill pipe. According to the invention it is provided that the pipe bunker is axially adjustably mounted with respect to the carriage on said carriage. The invention also relates to a method for installing or erecting a drilling pillar, which can be implemented with a drilling implement according to the invention.

8 Claims, 3 Drawing Sheets

DRILLING IMPLEMENT AND METHOD FOR INSTALLING A DRILLING PILLAR IN THE GROUND

BACKGROUND OF THE INVENTION

1. Field of the Invention

The invention relates to a drilling implement for installing or erecting a drilling pillar in the ground, having a mast, a carriage displaceably mounted on the mast, a drilling drive located on the carriage for the rotary driving of a drill pipe and a pipe hopper connectable to the drill pipe and having a storage area for the fill material for filling a hole on drawing the drill pipe.

The invention also relates to a method for installing or erecting a drilling pillar in the ground according, in which a drill pipe is introduced in rotary manner into the ground by means of a drilling drive located on a carriage, displaceable along a mast in the drilling direction and after reaching a desired depth the drill pipe is retracted and a cavity which is formed is filled by means of the drill pipe with fill material from a pipe hopper located on the drill pipe.

2. Related Art

Such a drilling implement is e.g. known from EP 1 580 325 A1. In the case of this known drilling implement, at the top of a multipart drill pipe is provided a pipe hopper for receiving concrete for filling a drill hole. The pipe hopper is retained at the top on a rotary drive displaceable by means of a carriage along a mast. During drilling, the pipe hopper is rotated by means of the rotary drive and the pipe hopper transmits the rotation to the drill pipe. For filling the resulting drill hole, by means of the drill pipe concrete from the pipe hopper is introduced into the ground.

Another drilling implement with a pipe hopper located on the top of a drill pipe is known from U.S. Pat. No. 5,647,690.

SUMMARY OF THE INVENTION

The object of the invention is to so further develop such a drilling implement and such a method that particularly good usability and universality are achieved.

According to the invention the object is achieved by a drilling implement having a mast, a carriage displaceably mounted on the mast, a drill pipe, a drilling drive located on the carriage for the rotary driving of the drill pipe, and a pipe hopper connectable to the drill pipe, the drilling drive having a storage area for fill material for filling a drill hole on drawing the drill pipe, and the pipe hopper being axially, adjustably mounted on the carriage; and a method for erecting a drilling pillar in the ground using the inventive drilling, comprising the steps of introducing the drill pipe in rotary manner into the ground using the drilling drive, after reaching a desired depth, retracting the drill pipe to form a cavity, and using the drill pipe to fill the cavity with fill material from the pipe hopper, wherein on introducing the drill pipe, the pipe hopper together with the drill pipe is movable towards the ground relative to the carriage.

A drilling implement according to the invention is characterized in that the pipe hopper, with respect to the carriage, is axially adjustably mounted on the carriage.

A first fundamental idea of the invention is to provide the pipe hopper adjustable axially relative to the carriage, i.e. in particular so that it is axially displaceable and fixable in several axial positions. It is consequently possible to vary the axial spacing of the pipe hopper with respect to the carriage, whilst the drill pipe for rotary driving can remain coupled in a torque proof manner with the drilling drive. Thus, e.g. for filling with fill material, the pipe hopper can be moved relative to the carriage into a position in which it is particularly readily accessible. In particular, by axial adjustment of the pipe hopper, the axial travel can be increased during the insertion or drawing of the drill pipe.

A pipe hopper can in particular be understood to mean a fill material container to which a drill pipe is connectable. Appropriately, the pipe hopper is axially located at the top, i.e. on the drill pipe end remote from the drill bit. According to the invention, the pipe hopper can be positioned in an extension of the drill pipe. In the sense of the invention, the axial direction can in particular be understood to mean the longitudinal direction of the drill pipe and/or the displacement direction of the carriage on the mast.

Further, according to the invention, the drill hopper, together with the drill pipe, is axially adjustably mounted with respect to the carriage. Appropriately, the drill pipe is fitted in an axially immovable manner relative to the pipe hopper. In particular, on the pipe hopper can be provided a pipe coupling for the releasable fitting of the drill pipe. The drill pipe appropriately has a multipart construction.

A particularly compact drilling implement with a considerable drilling travel can, according to the invention, be obtained in that the pipe hopper is positioned axially above the drilling drive and/or the carriage and that the drill pipe, at least sectionally, is positioned axially below the drilling drive and/or the carriage. According to this embodiment, the union formed by the pipe hopper and the drill pipe passes axially through the drilling drive and/or the carriage.

As a filled pipe hopper generally has a comparatively high moment of inertia, it can be advantageous to mount it in a torque proof manner on the carriage. This makes it possible to keep low the necessary drilling drive power and ensure a particularly easy fillability of the pipe hopper.

However, for a constructionally particularly simple and economic drilling implement, it is also possible for the pipe hopper to be provided in rotary manner on the carriage, and in particular provided in a torque proof manner on the drill pipe. In this case the pipe hopper can be rotated by means of the drilling drive during the rotation of the connected drill pipe. So as in this case to permit a simple filling of the pipe hopper, appropriately a device for feeding the fill material into the pipe hopper is provided and is arranged in a torque proof manner with respect to the carriage and/or mast. This feed device can, e.g., have a tube connection for a concrete supply line.

Particularly, if the pipe hopper is provided in a torque proof manner on the carriage, it is advantageous to provide a rotary coupling between the pipe hopper and the drill pipe and which uncouples a rotation of the drill pipe from the pipe hopper. Appropriately, the rotary coupling is provided axially above the drilling drive. Such a rotary coupling can also be called a swivel.

Additionally or alternatively, a rotary coupling can be provided between the feed device and the pipe hopper.

According to the invention, it is particularly advantageous to have on the carriage a torque support for the torque proof supporting of the pipe hopper and/or the feed device for feeding fill material into the pipe hopper.

It is also advantageous that the pipe hopper and/or the feed device are axially displaceably guided on the torque support. The torque support can, e.g., have an axially directed jib located on the carriage and on which the pipe hopper and/or the feed device is axially displaceably guided, e.g. by means of a carriage or a sleeve guide.

It is fundamentally possible to axially displace the pipe hopper relative to the carriage, e.g. by gravity action and/or by the displacement of the carriage with the pipe hopper fixed. However, it is particularly advantageous to provide, more particularly on the carriage, a drive mechanism for the active axial displacement of the pipe hopper. It is, e.g., possible to provide a linear drive, which is on the one hand located on the pipe hopper and on the other on the carriage. Preferably the drive mechanism is located on the torque support.

According to the invention, between the drill pipe and the pipe hopper is provided an extension pipe, which is preferably connected in axially displaceable, torque proof manner to a driven shaft of the drilling drive. To this end the extension pipe can, e.g., have a splined shaft tooth system. Appropriately, the extension pipe runs axially through the rotary drive and past the carriage. The extension pipe can, e.g., have a telescopic construction, particularly in the form of a kelly bar with longitudinal webs for torque transmission and locking pockets for the application of axial forces. According to the invention, at the lower end of the extension pipe can be provided a coupling device for coupling the drill pipe.

It is also advantageous for the driven shaft of the drilling drive to be constructed as a hollow shaft, on whose one side is located the pipe hopper and on whose other side passes at least sectionally the drill pipe. In particular, the extension pipe and/or the drill pipe can run in axially displaceable manner within the hollow shaft.

It is also advantageous that a closure device is provided through which access for fill material from the pipe hopper to the drill pipe can be closed. The closure device can, e.g., have a flap, which is provided at the bottom on the pipe hopper, on the extension pipe, and/or at the top on the drill pipe. Such a closure device is particularly advantageous when working with a multipart drill pipe.

The method according to the invention is characterized in that on inserting the drill pipe the pipe hopper together with the drill pipe is moved towards the ground relative to the carriage. This makes it possible to increase the axial travel of the drilling implement and in particularly simple manner particularly deep drilling pillars can be erected. Appropriately on retracting the drill pipe the pipe hopper together with the drill pipe is moved away from the ground relative to the carriage, i.e. moved upwards.

The method according to the invention can in particular be performed with the drilling implement according to the invention, so that the advantages explained in said connection are achievable.

BRIEF DESCRIPTION OF THE DRAWINGS

The invention is described in greater detail hereinafter relative to preferred embodiments and the attached diagrammatic drawings, wherein show.

Identically or analogically acting elements are given the same reference numerals throughout the drawings.

DETAILED DESCRIPTION OF THE PREFERRED EMBODIMENTS

Figure 1:
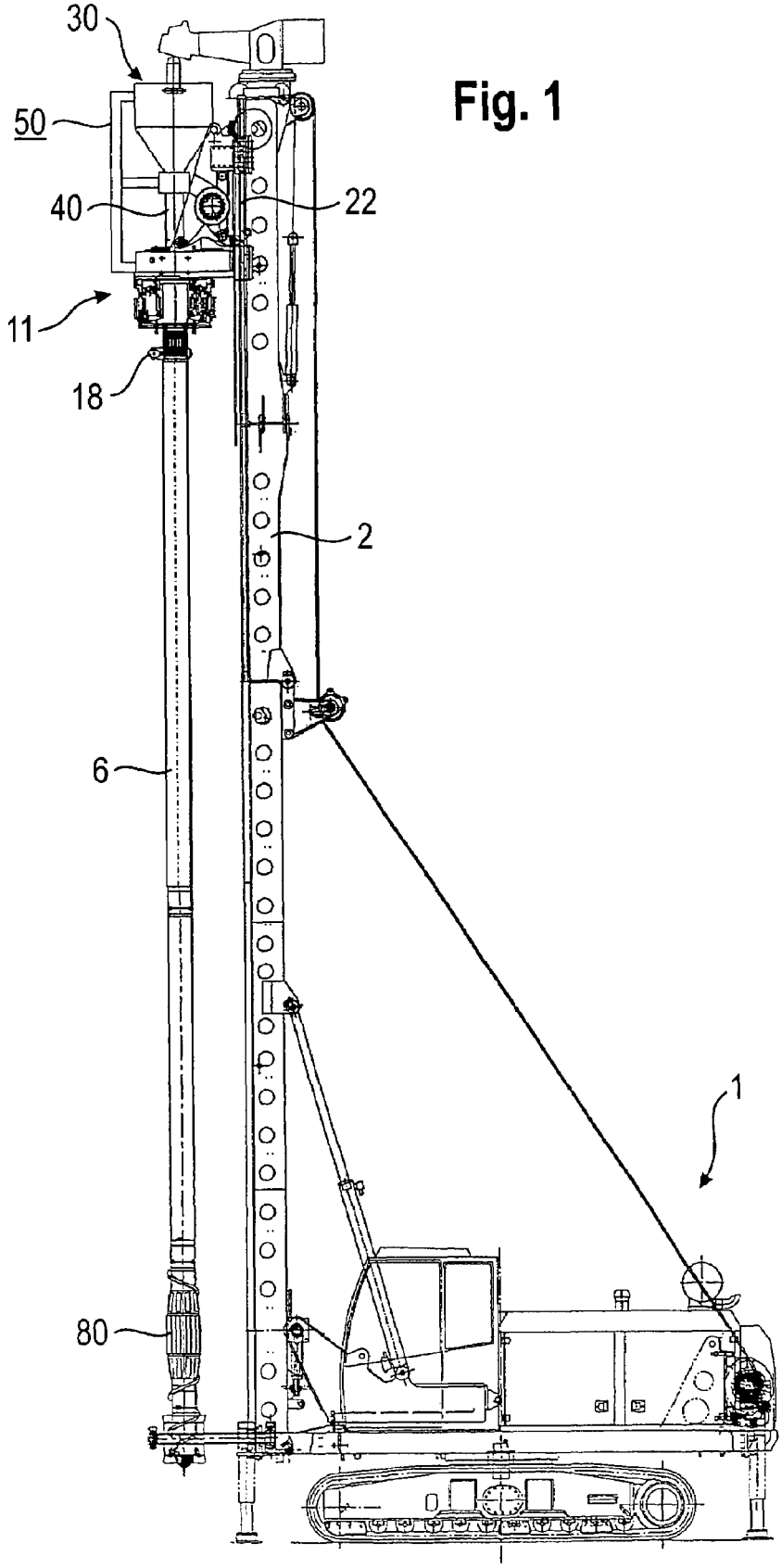
FIG. 1: An embodiment of an inventive drilling implement for performing the inventive method.
Figure 2:
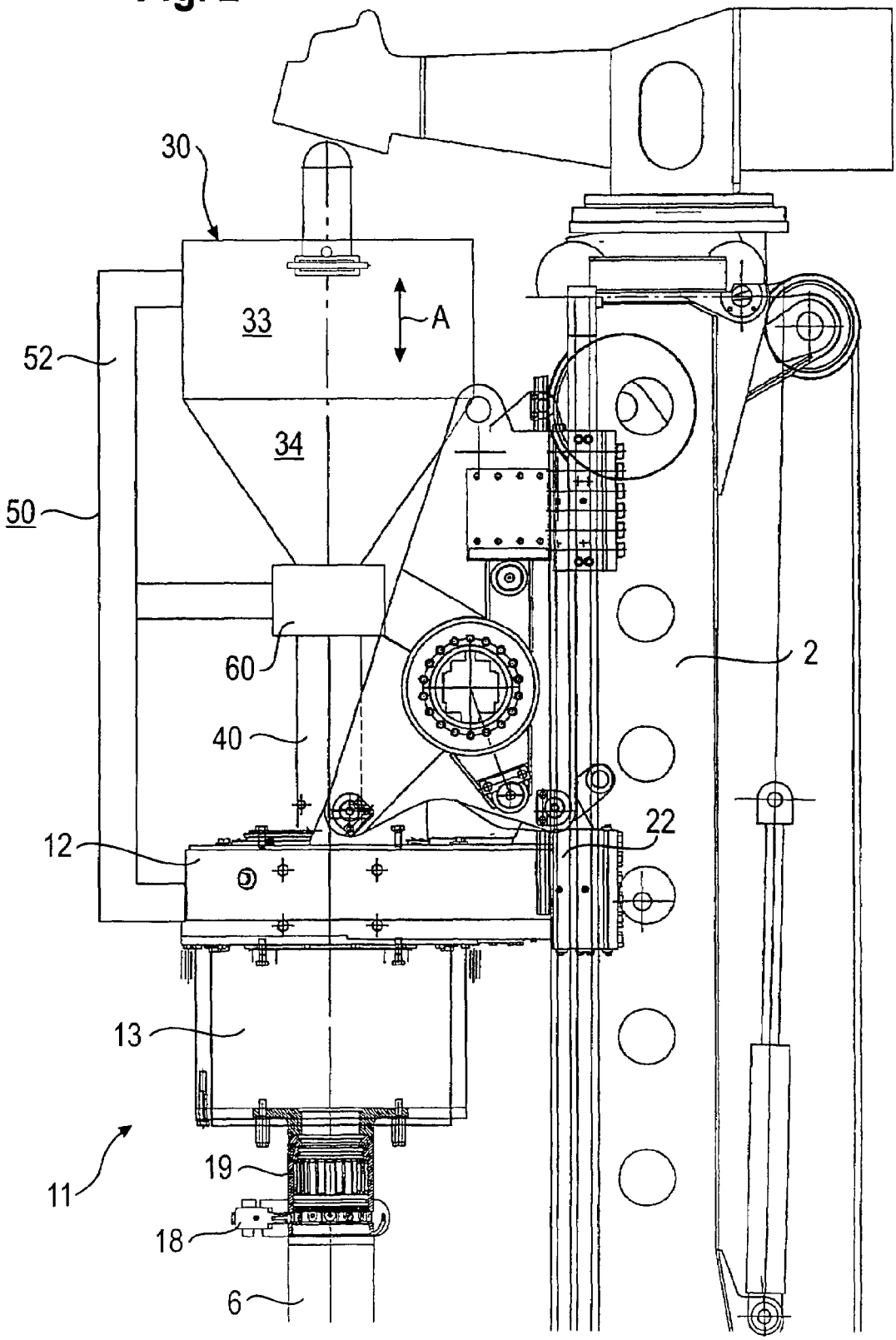
FIG. 2: A detail view of the drilling implement of FIG. 1 in the vicinity of the carriage.

A first embodiment of an inventive drilling implement is shown in FIGS. 1 and 2. The drilling implement has a chassis 1 on which is pivotably located a mast 2. A carriage 22 displaceably guided along the mast 2 is provided on the front of the latter.

On carriage 22 is provided a drilling drive 11 displaceable with the carriage 22 along mast 2 and with which it is possible to rotate a drill pipe 6 with a displacement drill head 80 running along mast 2. The drilling drive has an upper drive part 12, in which is provided a not shown drive motor, as well as a gear part 13 located below the same. On the bottom of the gear part 13 is provided a driven shaft 19 in the form of a hollow shaft.

In the extension of the drill pipe 6 an extension pipe 40 is provided at the top of the drill pipe 6. This extension pipe 40 is coupled in axially fixed and torque proof manner with the drill pipe 6 by means of a pipe coupling 18. The extension pipe 40 runs axially through the drilling drive 11. At the top end of extension pipe 40 and above the drilling drive 11 and in an extension of the extension pipe 40 and the drill pipe 6 is provided a pipe hopper 30. The pipe hopper 30 serves to receive fill material, which via extension pipe 40 can be introduced by means of the drilling drive 11 into drill pipe 6.

Pipe hopper 30 together with the extension tube 40 located thereon and the drill pipe 6 are located axially displaceably, i.e. in the direction of arrow A, relative to the drilling drive 11 and carriage 22. In FIGS. 1 and 2, pipe hopper 30 is in an upper position, in which it is located at a comparatively large distance from the drilling drive 11. From said position and together with the drill pipe 6 located thereon, it can be moved downwards towards the ground, so that the existing length of the drill pipe 6 below carriage 22 and drilling drive 11 increases.

For torque transmission between drilling drive 11 and drill pipe 6, movable axially with respect thereto, the extension pipe 40 connected in a torque proof manner with drill pipe 6 is externally provided with a spline corresponding to internal teeth in drive shaft 19.

For fixing an axial relative position of pipe hopper 30 and drill pipe 6 relative to carriage 22, a not shown holding device is provided on drilling drive 11 and it, e.g., positively and/or non-positively holds extension pipe 40.

On the bottom side of pipe hopper 30 is provided a rotary coupling 60, which uncouples a rotation of drill pipe 6 and extension pipe 40 located thereon from pipe hopper 30.

On carriage 22 is provided a torque support 50, which couples the pipe hopper 30 in torque proof manner on carriage 22. The torque support has an axially directed jib 52, on which the pipe hopper 30 is axially displaceably guided by means of a side arm. By means of a further side arm, the rotary coupling 60 and in particular its fixed part, is axially displaceable and in a torque proof manner guided on jib 52. The axially directed jib 52 of torque support 50 can, e.g., also be telescopable.

Pipe hopper 30 has a roughly cylindrical storage area 33, which is connected to extension pipe 40 by means of a conical outlet area 34 located below the same.

Figure 3:
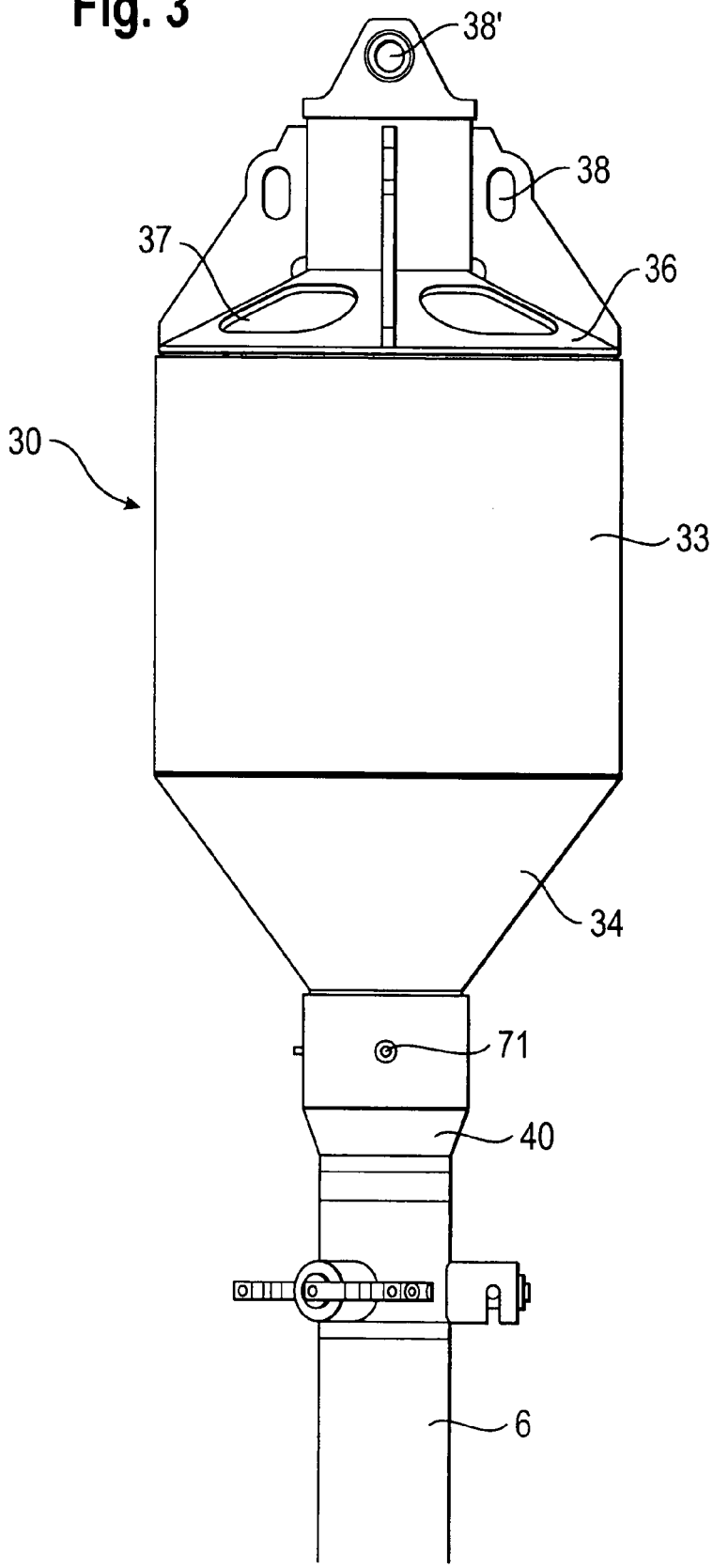
FIG. 3: An alternative designed pipe hopper for use in an inventive drilling implement.

FIG. 3 shows an alternatively constructed pipe hopper 30 for use in an inventive drilling implement. The pipe hopper of FIG. 3 has at the top of the cylindrical storage area 33 a roughly conically constructed cover 36. In the cover 36 are provided several filling openings 37 for filling fill material into the interior of pipe hopper 30. On the cover are also provided several rings 38, 38' for the raising of pipe hopper 30 using auxiliary equipment.

The pipe hopper of FIG. 3 also has a closure device 71 constructed as a flap between outlet area 34 and extension pipe 40 and makes it possible to close off a fill material passage between the interior of pipe hopper 30 and the interior of extension pipe 40 and therefore the interior of drill pipe 6.

The invention claimed is:

1. A drilling implement for erecting a drilling pillar in the ground, comprising:

a mast, a carriage displaceably mounted on the mast, a drill pipe, a pipe hopper connected to the drill pipe, the pipe hopper forming a unit together with the drill pipe when connected therewith, the unit being mounted on the carriage for axially adjustable movement relative the carriage, the pipe hopper having a storage area for fill material for filling a drill hole on drawing the drill pipe, and a drilling drive located on the carriage for the rotary driving of the drill pipe.

2. Drilling implement according to claim 1, wherein the pipe hopper is located axially above the drilling drive and the drill pipe is at least sectionally axially located below the drilling drive.

3. Drilling implement according to claim 1, further comprising a rotary coupling provided between the pipe hopper and the drill pipe for uncoupling the rotation of the drill pipe from the pipe hopper.

4. Drilling implement according to claim 1, further comprising:

a feed device for feeding fill material into the pipe hopper, and a torque support provided on the carriage for supporting at least one of the pipe hopper and the feed device in a torque-proof manner.

5. Drilling implement according to claim 4, wherein at least one of the pipe hopper and the feed device is axially displaceably guided on the torque support.

6. Drilling implement according to claim 1, wherein the drilling drive includes a driven shaft, and wherein the drilling implement further comprises an extension pipe provided between the drill pipe and the pipe hopper, wherein the extension pipe is connected in an axially displaceable and torque-proof manner to the driven shaft of the drilling drive.

7. Drilling implement according to claim 1, further comprising closure means for closing off an access for fill material from the pipe hopper to the drill pipe.

8. A method for erecting a drilling pillar in the ground using the drilling implement according to claim 1, comprising the steps of introducing the drill pipe into the ground in a rotary manner using the drilling drive, on introducing the drill pipe into the ground, moving the unit formed by the pipe hopper together with the drill pipe axially towards the ground relative to the carriage, after reaching a desired depth, retracting the drill pipe to form a cavity, and using the drill pipe to fill the cavity with fill material from the pipe hopper.

* * * * *